US008650995B1

(12) United States Patent
Gillum

(10) Patent No.: US 8,650,995 B1
(45) Date of Patent: Feb. 18, 2014

(54) SANDPAPER CUTTING TOOL

(75) Inventor: Thomas Gillum, Riverside, CA (US)

(73) Assignee: Thomas Gillum, Riverside, CA (US)

( * ) Notice: Subject to any disclaimer, the term of this patent is extended or adjusted under 35 U.S.C. 154(b) by 344 days.

(21) Appl. No.: 13/204,901

(22) Filed: Aug. 8, 2011

(51) Int. Cl.

| | |
|---|---|
| ***B26D 1/00*** | (2006.01) |
| ***B26D 3/00*** | (2006.01) |
| ***B26F 3/00*** | (2006.01) |
| ***B26F 3/02*** | (2006.01) |
| ***B65H 35/00*** | (2006.01) |

(52) U.S. Cl.
USPC ..... 83/13; 225/1; 225/38; 225/6

(58) Field of Classification Search
USPC ..... 83/13, 468, 607; 225/1, 6, 38, 91; 33/32.1, 628, 630, 562, 566; 30/289, 30/279.2
See application file for complete search history.

(56) References Cited

U.S. PATENT DOCUMENTS

| | | | | | |
|---|---|---|---|---|---|
| 492,354 | A | * | 2/1893 | Harrison | 225/81 |
| 3,973,459 | A | * | 8/1976 | Stowe | 83/455 |
| 3,991,922 | A | * | 11/1976 | Martin | 225/17 |
| D296,864 | S | | 7/1988 | Moulton | |
| 4,979,612 | A | * | 12/1990 | Melbye | 206/216 |
| 5,287,625 | A | * | 2/1994 | Herron | 30/289 |
| 5,511,316 | A | * | 4/1996 | Fischer et al. | 33/1 F |
| 5,524,515 | A | * | 6/1996 | Boda | 83/455 |
| 5,537,904 | A | * | 7/1996 | Albin | 83/455 |
| D375,034 | S | * | 10/1996 | Bowser | D8/98 |
| D376,606 | S | * | 12/1996 | Thompson | D15/127 |
| 6,138,884 | A | * | 10/2000 | Gish | 225/1 |
| 2005/0109186 | A1 | * | 5/2005 | O'Donnell et al. | 83/856 |

* cited by examiner

*Primary Examiner* — Ghassem Alie
*Assistant Examiner* — Bharat C Patel

(57) ABSTRACT

A sandpaper cutting tool having a substantially rectangular multi-tiered platform including a first and second measuring surface, a top surface, and a back. The second measuring surface is positioned between the first measuring surface and the top surface. The first measuring, second measuring, and top surfaces vertically align and define the back. The first measuring surface has a front cutting edge and a first blade having a serrated edge vertically aligned adjacent the front cutting edge. The second measuring surface has a front cutting edge and a second blade having a serrated edge vertically aligned adjacent the front cutting edge. A first backstop is defined between the first measuring surface and the second measuring surface. A second backstop is defined between the second measuring surface and the top surface.

7 Claims, 2 Drawing Sheets

SANDPAPER CUTTING TOOL

BACKGROUND OF THE INVENTION

1. Field of the Invention

The invention relates to cutting tools, and more particularly, to a sandpaper cutting tool and method of same for cutting sandpaper to the exact measurements required for a ¼ sheet sander. The sandpaper cutting tool is lightweight and uniquely designed having two pre-measured flat cutting surfaces each having two serrated blades for quickly and easily cutting full sized sheets of sandpaper into four one-quarter size pieces of sandpaper.

For any member of the woodworking profession, or the millions of do-it-yourself home improvement experts, a sander is an indispensable tool, particularly the ¼ sheet sander which is the industry standard. The widely used ¼ sheet sander requires sandpaper in a specific size in order to fit properly. The ¼ sheet sander contains a pad measuring approximately four and one-half inches by four and one-half inches (4.5"×4.5") on which a piece of sandpaper is secured. A one quarter sheet of sandpaper measuring five and one-half by four and one-half inches (5×4½") is inserted underneath the pad, and the ends of the sandpaper are folded up and over the edges of the pad and secured by clips. The sander uses a motor that moves the pad in a back and forth, circular motion at a high speed, allowing the user to remove material fairly quickly and easily.

A frustrating feature of using the ¼ sheet sander is obtaining the correct size sandpaper. Currently, store bought sandpaper only comes in large sheets measuring nine by eleven inches (9×11") or pre-cut squares. Pre-cut squares are expensive, leaving the average consumer with the alternative of buying large sheets and manually cutting them to achieve the correct size.

There is no process for quickly measuring and cutting sandpaper. The user must first measure the correct specifications. Once the correct dimensions are measured, the most common way of cutting the sandpaper is using a knife or scissors, and this method is both imprecise and time consuming. Furthermore, cutting sandpaper dulls the knife or scissors, leaving them less useful for Other tasks. The present invention seeks to resolve the foregoing issues by providing a quick and easy means to measure and cut correctly the exact size sandpaper for use in a ¼ sheet sander.

2. Description of the Related Art

U.S. Pat. No. D296,864 to Moulton discloses an ornamental design for a sandpaper cutter.

U.S. Pat. No. D375,034 to Bowser, discloses an ornamental design for a sandpaper and fibrous material cutter.

U.S. Pat. No. D376,606 to Thompson discloses an ornamental design for a sandpaper cutting board.

U.S. Pat. No. 3,991,922 to Martin discloses a cutting board for abrasive material sheets, wherein they may be simultaneously measured and cut to order, comprising portable base member, grooved at measured locations, transversely thereof in coactive relationship to at least one upright guide and to means for severing the sheet.

U.S. Pat. No. 5,287,625 to Herron discloses an improved sandpaper cutting guide having a series of recesses to receive different sized pieces of sandpaper. The longer side of a standard sized sheet of sandpaper is placed in one of the slots for cutting the sheet in half or the end of the standard, sized sheet may be placed in another slot for cutting a one-third sheet piece. A cutting tool is inserted through a slit in the guide and drawn across the guide to cut a selected one of several smaller, also standard, piece sized from the sheet. The same slit guides the cutting tool for all sizes with size being determined by the recess into which the sheet is placed. Access Openings, are provided to aid in removal of the cut piece from the guide. Preferably recesses are provided for cutting the standard sized sheet into halves, thirds, quarters or sixths.

U.S. Pat. No. 6,138,884 to Gish discloses an apparatus for sizing bulk sandpaper to produce individual sandpaper sheets suitable for use in hand and powered sanders. A planar member, typically made of clear plastic is provided with a number of marked indicia indication standard sized for sander sheets. One or more sides of the planar member may be provided with a cutting edge whether attached to or molded onto the planar member to hold sandpaper in place for sizing. In use, a user places the device over a sheet of sandpaper on a workbench or the like and aligns the sandpaper to the desired size indicia. Applying mild pressure to the handle the user may then tear or cut the sandpaper to the desired size. The apparatus may be economically made without moving parts and may be readily transported in a tool box, pail or the like.

While these units may be suitable for the particular purpose employed, or for general use, they would not be as suitable for the purposes of the present invention as disclosed hereafter.

SUMMARY OF THE INVENTION

It is an object of the invention to produce a quick and easy means of precisely cutting full sized sheets of sandpaper for use with a ¼ sheet sander. Accordingly, the sandpaper cutting tool of the present invention has an upwardly extending multi-tiered platform having a first and second measuring surface each having a front cutting edge aligned with a serrated blade for precisely cutting full sized piece's of sandpaper.

It is another object of the invention to provide a means for cutting a nine by eleven inch (9×11") sheet of sandpaper into equal quarters of five and one-half by four and one-half inches (5½×4½"). Accordingly, the first measuring surface of the sandpaper cutting tool of the present invention allows the user to cut a nine by eleven inch sheet of sandpaper into half thereby producing two one half sheets, while the second measuring surface of the sandpaper cutting tool of the present invention allows the user to cut each half sheet again in half, thereby producing four quarter sheets each measuring five and one-half by four and one-half inches.

It is yet another object of the invention to provide a convenient means for precisely measuring the sandpaper without having to utilize another measuring tool, like a tape measure, to manually measure the desired size. Accordingly, the sandpaper cutting tool of the present invention has a top surface creating a highest elevation, wherein a first backstop is defined between the first and second measuring surfaces and a second backstop is defined between the second measuring surface and the top surface. The first and second backstops allow the user to align the sandpaper atop the measuring surfaces adjacent the backstops to achieve the precise dimensions required to cut the sandpaper.

It is another object of the invention to provide a convenient and quick means for cutting the sandpaper by using integrated serrated blades. Accordingly, the serrated blades of the first and second measuring surfaces of the sandpaper cutting tool of the present invention are aligned with each surfaces front cutting edge, such that once the user positions the sandpaper along the designated measuring surface, the user simply pulls the sandpaper in an upwardly motion for cutting the sandpaper along the serrated blade.

It is another object of the invention to provide a cutting tool that is manually operated by the user. Accordingly, the sandpaper cutting tool of the present invention only requires that the user insert the sandpaper along each measuring surface and use each serrated blade to cut the sandpaper for achieving the precise dimensions manually without the need for electronic components.

It is yet another object of the invention to provide a cutting tool which is easily positionable and stable along a flat surface during use. Accordingly, in an alternate embodiment, a bottom of the sandpaper cutting tool has a non-slip means coupled to the first cutting surface for allowing the user to place the cutting tool on any flat surface for use.

It is another object of the invention to provide a cutting tool wherein the sandpaper is easily secured along the measuring surfaces. Accordingly, in an alternate embodiment, the first and second backstops of the sandpaper cutting tool have a securing means for maintaining the positioning of the sandpaper along the first and second measuring surfaces as the user cuts the sandpaper.

It is another object of the invention to provide a cutting tool which is easily securable to a workbench. Accordingly, in an alternate embodiment, the first and second measuring surfaces of the sandpaper cutting tool include at least two pre-drilled screw holes which allow the user to attach the cutting the tool with a screw to a workbench easily and quickly.

It is yet another object of the invention to provide a lightweight cutting tool. Accordingly, in the preferred embodiment, the sandpaper cutting tool is made from lightweight wood or thermoplastic which provides an lightweight and easy to transport tool.

This invention is a sandpaper cutting tool having a substantially rectangular multi-tiered platform including a first and second measuring surface, a top surface, and a back. The second measuring surface is positioned between the first measuring surface and the top surface. The first measuring, second measuring, and top surfaces vertically align and define the back. The first measuring surface has a front cutting edge and a first blade having a serrated edge vertically aligned adjacent the front cutting edge. The second measuring surface has a front cutting edge and a second blade having a serrated edge vertically aligned adjacent the front cutting edge. A first backstop is defined between the first measuring surface and the second measuring surface. A second backstop is defined between the second measuring surface and the top surface.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
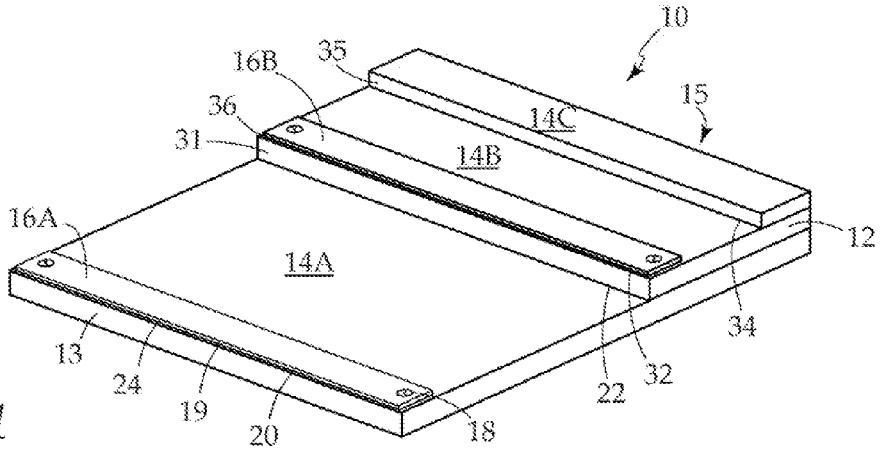
FIG. 1 is a diagrammatic perspective view of the sandpaper cutting tool of the present invention having first and second measuring surfaces each having a blade.

FIG. 1 illustrates a sandpaper cutting tool 10 specially designed for easily and efficiently cutting sandpaper to the precise dimensions required for use with a ¼ sheet sander. In its broadest context, the tool 10 has a platform 12 having a plurality of surfaces 14, and at least two blades 16 for creating precise, straight, and even cuts.

The sandpaper cutting tool 10 is particularly useful for cutting a nine by eleven inch (9×11") sheet of sandpaper into equal quarters of five and one-half by four and one-half inches (5½×4½") for use with a standard ¼ sheet sander. The sheet sander is a hand held tool well known in the construction and woodworking art industry to sand wood to a smooth surface. However, the ¼ sheet sander requires sandpaper in a specific size in order to fit properly for use. This size requirement proves frustrating as sandpaper is only available for purchase in full sheet sizes or pre-cut quarters, which are expensive.

In the preferred embodiment, the platform 12 of the tool 10 is substantially rectangular and measures eleven inches (11") in length, by eleven and three-sixteenths inches (11 3/16") in width. The platform 12 has a front 13 and a back 15. In the preferred embodiment, the multi-tiered platform 12 includes a plurality of surfaces 14 extending between the front 13 and back 15. Preferably, the platform 12 includes two rectangular flat measuring surfaces 14, specifically a first measuring surface 14A and a second measuring surface 14B, both aligned vertically along the back 15. The platform 12 has a top surface 14C positioned on top of the second measuring surface 14B which is also aligned with the first and second measuring surfaces 14A and 14B along the back 15.

The surfaces 14 are stacked vertically on top of one another, thereby defining a tiered or step like tool 10. Such that the first measuring surface 14A creates a base with the second measuring surface 14B positioned atop the first measuring surface 14A near the back 15 of the platform 12. A top surface 14C is posited atop the second measuring surface 14B near the back 15. The three surfaces 14 are vertically aligned and define the back 15 of the platform 12. The first measuring surface 14A is one-half inch (½") in height, the second measuring surface 14B is one-half inch (½") in height and the top surface 14C is one-half (½") in height. Therefore, with all three surfaces 14 in position, the platform 12 is one-half inch (½") in height at the front 13 along the first measuring surface 14A, and increases to one inch (1") in height along the second measuring surface 14B and finally increases to one and one-half inches (1½") in height at the back 15. A first backstop 31 is defined between the first measuring surface 14A and the second measuring surface 14B. A second backstop 35 is defined between the second measuring surface 14B and the top surface 14C. Preferably, the platform 12 is constructed from wood or a tough, lightweight and durable injection-molded thermoplastic. The lightweight design allows the user to easily transport the tool 10 to and from a construction site.

The first measuring surface 14A has a front cutting edge 20 and a back stopping edge 22 for allowing the sandpaper to align correctly and rest atop the first Measuring surface 14A when positioned. Coupled to the first measuring surface 14A near the front cutting edge 20 is a first blade 16A for easily cutting sandpaper. The first blade 16A is preferably ten and thirteen-sixteenths inches (10 13/16") in length. Preferably, the first blade 16A is made out of steel. In alternate embodiments wherein the platform 12 is made from thermoplastic, the first blade 16A is also made from thermoplastic. The first blade 16A has a serrated edge 24 positioned along the front cutting edge 20 such that the serrated edge 24 is vertically aligned adjacent the front cutting edge 20. This allows for easily cutting a piece of sandpaper with straight, clean lines. In the preferred embodiment, the first blade 16A is coupled to the first measuring surface 12A by screws 18. Other coupling means are contemplated to secure the first blade 16A to the first measuring surface 14A.

An opening 19 is defined between the first blade 16A and the first measuring surface 14A. Preferably, the opening 19 is one thirty-second of an inch (1/32"). The opening 19 allows the user to insert a sheet of sandpaper 30 (shown in FIG. 3) between the first blade 16A and first measuring surface 14A such that the sandpaper 30 is positioned underneath the first blade 16A and positioned atop the first measuring surface 14A for cutting the sandpaper 30 into the desired dimension. The first measuring surface 14A is precisely designed such that as the sandpaper 30 is inserted through the opening 19, the first backstop 31 provides a barrier for the sandpaper 30 allowing the exact dimension required to cut the sandpaper 30 in half. Thus, when the serrated edge 24 of the first blade 16A is used to cut the sandpaper 30, the full sheet of sandpaper 30 is split exactly in half, yielding cut sandpaper of nine inches by five and one-half inches (9×5½).

Similarly, the second measuring surface 14B has a front cutting edge 32 and a back stopping edge 34. Coupled to the second measuring surface 14B near the front cutting edge 32 is a second blade 16B. The second blade 16B is similar in dimensions and material as the first blade 16A. The second blade 16B has a serrated edge 36 positioned along the front cutting edge 32 such that the serrated edge 36 is vertically aligned adjacent the front cutting edge 32 for easily cutting the sandpaper 30. In the preferred embodiment, the second blade 16B is coupled to the second measuring surface 14B by screws 18. Other coupling means are contemplated to secure the second blade 16B to the second measuring surface 14B.

An opening 36 is defined between the second blade 16B and second measuring surface 14B. Preferably, the opening 36 is one thirty-second of an inch (1/32"). The opening 36 allows the user to insert a half sheet of sandpaper 40 (shown in FIG. 4) between the second blade 16B and second measuring surface 14B such that the half sheet of sandpaper 40 is positioned underneath the second blade 16B and atop the second measuring surface 14B for cutting the half sheet of sandpaper 40 into the desired dimension. The second measuring surface 14B is precisely designed such that as the half sheet of sandpaper 40 is inserted through the opening 36, the second backstop 35 provides a barrier for the half sheet of sandpaper 40 allowing the exact dimensions required to the cut the half sheet of sandpaper 40 in half. Thus, when the serrated edge 36 of the second blade 16B is used to cut the half sheet of sandpaper 40, two quarter pieces measuring five and one-half by four and one-half inches (5½×4½) are yielded. Thus providing sandpaper with the exact dimensions required for the ¼ sheet sander.

The first backstop 31 of the platform 12 is defined between the back stopping edge 22 of the first measuring surface 14A and the front cutting edge 32 of the second measuring surface 14B. Similarly, the second backstop 35 is defined between the back stopping edge 34 of the second measuring surface 14B and the top surface 14C. The first and second backstops 31, 35 are flat rectangular panels which provide the barrier for aligning the sandpaper atop the first and second measuring surfaces 14A, 14B and adjacent the front cutting edges 20, 32. When the sandpaper is aligned the exact dimensions are achieved for cutting.

Figure 2:
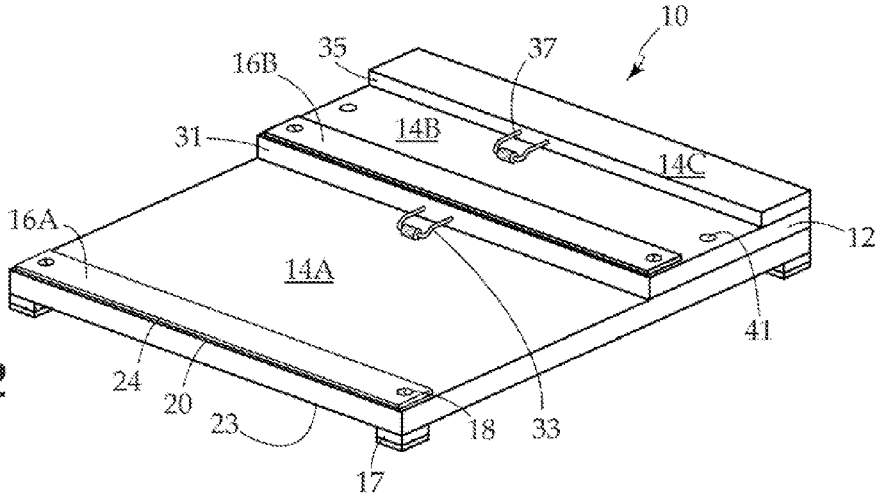
FIG. 2 is a diagrammatic perspective view of an alternate embodiment of the sandpaper cutting tool of the present invention illustrating a non-slip means, securing means, and at least two screw holes integrated within said tool.

In alternate embodiments, a first securing means 33 (shown in FIG. 2) is coupled to the first backstop 31. The first securing means 33 is similar to a clip such that the first securing means secures the sandpaper 30 to the first measuring surface 14A adjacent the first backstop 31. Similarly, a second securing means 37 is coupled to the second backstop 35. The second securing means 37 is similar to a clip such that the second securing means 37 secures the half sheet of sandpaper 40 to the second measuring surface 14B adjacent the second backstop 35.

In one alternate embodiment, a non-slip means is coupled to a bottom 23, preferably corner, of the first measuring surface 14A. Preferably, the non-slip means is similar to four legs 17 (shown in FIG. 2) which extend perpendicularly downward from the first measuring surface 14A. The legs 17 balance the cutting tool 10 on a flat surface for use. Preferably, the legs 17 are one-quarter inch (¼") in length and each leg 17 is rubber tipped which prevents the cutting tool 10 from slipping when placed on any flat surface.

In one alternate embodiment, at least two screw holes 41 (shown in FIG. 2) are positioned through the first and second measuring surfaces 14A, 14B of the platform 12. The screw holes 41 allow the user to easily and quickly couple the cutting tool 10 to a work bench, thereby making the cutting tool 10 easily accessible at a construction site.

Figure 3:
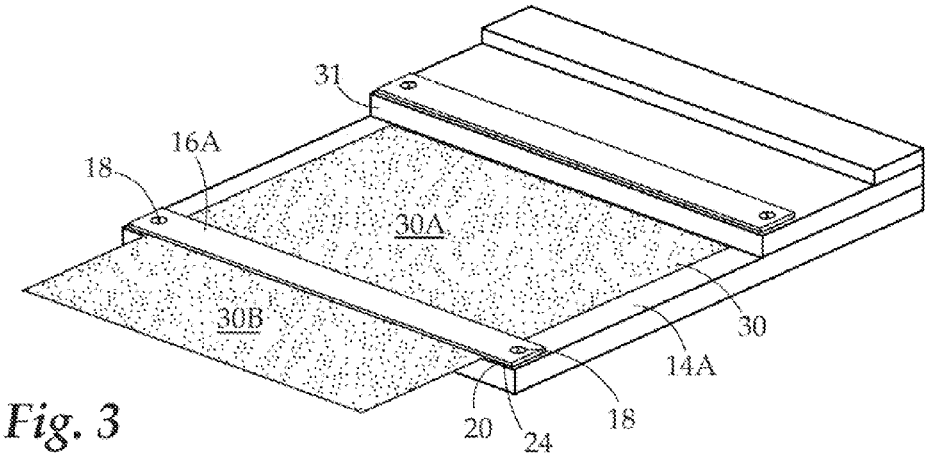
FIG. 3 is a diagrammatic perspective view of the sandpaper cutting tool of the present invention, illustrating a full sized sheet of sandpaper positionable on the first measuring surface, ready for use.
Figure 4:
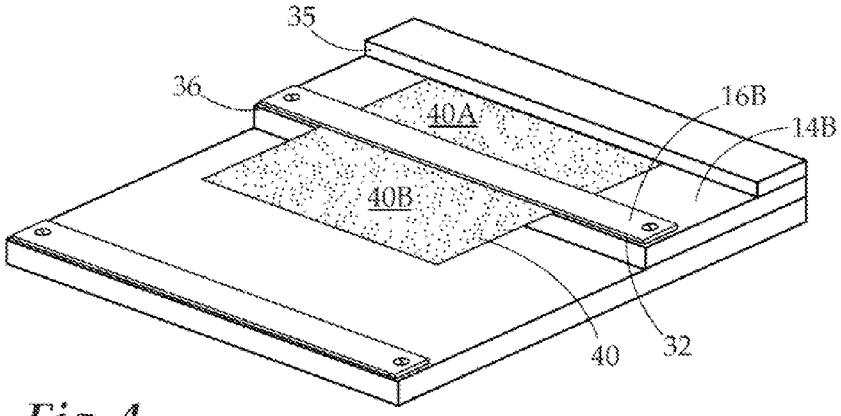
FIG. 4 is a diagrammatic perspective view of the sandpaper cutting tool of the present invention, illustrating a one-half sheet of sandpaper positionable on the second measuring surface, ready for use.
Figure 5:
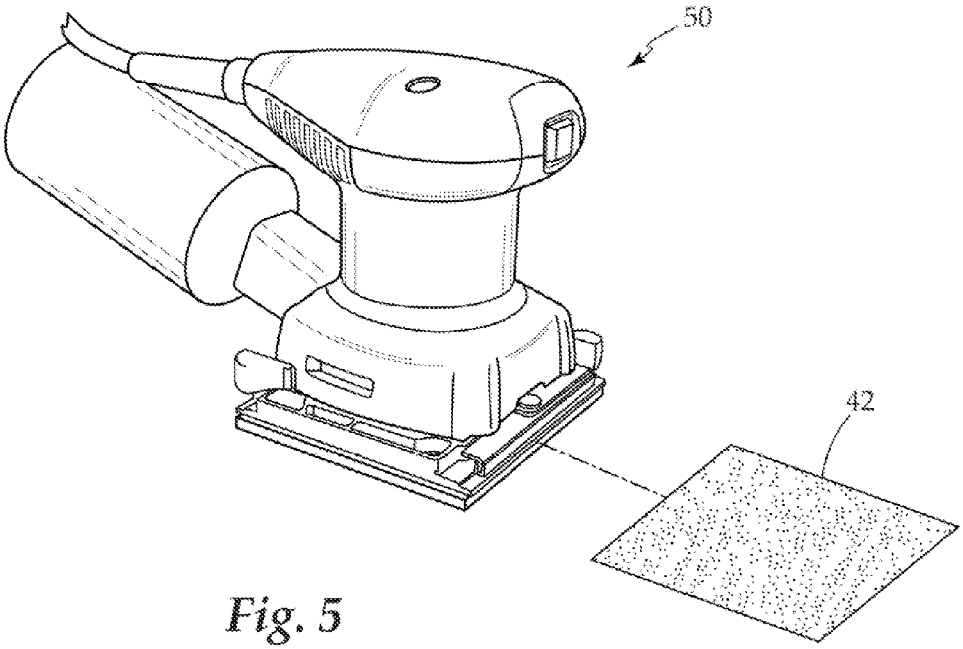
FIG. 5 is a diagrammatic perspective view of a ¼ sheet sander and a one-quarter sheet of sandpaper ready for insertable use therein.

FIGS. 3-4 illustrate the method of using the sandpaper cutting tool 10 to cut a nine by eleven inch (9×11") sheet of sandpaper 30 into four quartets for use in a ¼ sheet sander 50 (shown in FIG. 5). First, the user inserts a full size standard sheet of sandpaper 30 into the opening 19 between the first blade 16A and the first measuring surface 14A. The user slides the sandpaper 30 along the first measuring surface 14A until the sandpaper 30 is stopped by and positioned adjacent the first backstop 31. The screws 18 coupling the first blade 16A to the first measuring surface 14A are positioned such that the sandpaper 30 is insertable through the opening 19 by only a nine inch width, thereby ensuring that the first cut made by the user is along the eleven inch length. When the sandpaper 30 is in position, two half's of the sandpaper are defined, specifically an inner half 30A and an outer half 308. The inner half 30A is positioned atop the first measuring surface 14A flush against the first backstop 31. The outer half 30B extends horizontally underneath the opening 19 outwardly from the front cutting edge 20 of the first measuring surface 14A. Next, the user secures the sandpaper 30 by applying downward pressure to the inner half 30A of the sandpaper 30 against the first measuring surface 14A. The user then cuts the sandpaper 30 by pulling upwardly the outer half 30B of the sandpaper 30 at approximately a ninety-degree angle along the serrated edge 24 of the first blade 16A. Unlike the prior art, pulling upwardly at approximately a forty-five degree angle or approximately a one hundred and thirty-five degree angle will still yield the same perfect cut. Preferably, a ninety degree angle and upward pulling motion allows the user to obtain a clean, straight edge cut. When complete, two half sheets of sandpaper 40 result (FIG. 4), each five and one-half inches (5") in length, by nine inches (9") in width.

The user then sets the sandpaper 40 into position for the final cut by rotating one of the half sheets of sandpaper 40 ninety degrees (90°), and inserting the half sheet of sandpaper 40 into the opening 32 between the second blade 16B and the second measuring surface 12B. In a similar manner, the user applies downward pressure to the inner half 40A of the sandpaper 40 against the second measuring surface 14B while pulling the outer half 40B of sandpaper 40 in an upward ninety degree angle along the serrated edge 36 of the second blade 268. Unlike the prior art, pulling upwardly at approximately a forty-five degree angle approximately a one hundred and thirty-five degree angle will still yield the same perfect cut. This second cut yields two pieces of one-quarter sheet sandpaper 42 (FIG. 4), each five and one-half inches (5½") in length by four and one-half inches (4½") in width. Repeating the method to the second half sheet of sandpaper 40 yields four, quarter size pieces of sandpaper 42. Thereby, achieving the exact dimensions required for sandpaper for use in a ¼ sheet sander 50.

FIG. 5 illustrates a ¼ sheet sander 50 well known in the art. The sandpaper 42 is cut using the tool 10 of the present invention to the required dimensions and is ready for insertion into the ¼ sheet sander for use sanding wood or other like materials.

In conclusion, herein is presented a sandpaper cutting tool and method of same for cutting sandpaper into the exact dimensions for use with a ¼ sheet sander. The invention is illustrated by example in the drawing figures, and throughout the written description. It should be understood that numerous variations, modification and alternate embodiments are possible, while adhering to the inventive concept. It is understood that the present disclosure has been made only by way of example and that numerous changes in the details of construction and the combination and arrangement of parts may be resorted to without departing from the spirit and scope of the invention. Such variations and equivalent changes are contemplated as being a part of the present invention. Moreover, the invention as disclosed herein may be suitably practiced in the absence of the specific elements which are disclosed herein.

What is claimed is:

1. A sandpaper cutting tool for cutting sandpaper to dimensions required for a ¼ sheet sander, comprising:

a substantially rectangular multi-tiered platform having a front, a back, a substantially rectangular first measuring surface, a substantially rectangular second measuring surface, and a substantially rectangular top surface, wherein said second measuring surface is positioned on top of said first measuring surface near said back of said platform, wherein said top surface is positioned on top of said second measuring surface such that said first, second, and top surfaces are vertically aligned along said back of said platform and define three different vertical tiers of said platform;

said first measuring surface having a front cutting edge, a back stopping edge, and a first blade having a serrated edge, wherein said first blade is positioned near said front cutting edge, wherein said serrated edge is vertically aligned adjacent said front cutting edge;

said second measuring surface having a front cutting edge, a back stopping edge, and a second blade having a serrated edge, wherein said second blade is positioned near said front cutting edge, wherein said serrated edge is vertically aligned adjacent said front cutting edge;

a first backstop defined between said back stopping edge of said first measuring surface and said front cutting edge of said second measuring surface; and a second backstop defined between said back stopping edge of said second surface and said top surface.

2. The sandpaper cutting tool of claim 1, further comprising a means for preventing said platform from slipping on a flat surface, wherein said means couples to a bottom of said first measuring surface.

3. The sandpaper cutting tool of claim 1, further comprising at least two pre drilled screw holes positioned through said first and second measuring surfaces.

4. The sandpaper cutting tool of claim 1, further comprising a first securing means coupled to said first backstop and a second securing means coupled to said second backstop.

5. A sandpaper cutting tool for cutting sandpaper to dimensions required for a ¼ sheet sander, comprising:

a substantially rectangular multi-tiered platform having a front, a back, a substantially rectangular first measuring surface, a substantially rectangular second measuring, surface, and a substantially rectangular top surface, wherein said second measuring surface is positioned on top of said first measuring surface near said back of said platform, wherein said top surface is positioned on top of said second measuring surface such that said first, second, and top surfaces are vertically aligned along said back of said platform and define three different vertical tiers of said platform;

said first measuring surface having a front cutting edge, a back stopping edge, a bottom surface, and a first blade having a serrated edge, wherein said first blade is positioned near said front cutting edge, wherein said serrated edge is vertically aligned adjacent said front cutting edge;

said second measuring surface having a front cutting edge, a back stopping edge, and a second blade having a serrated edge, wherein said second blade is positioned near said front cutting edge, wherein said serrated edge is vertically aligned adjacent said front cutting edge;

a first backstop defined between said back stopping edge of said first measuring surface and said front cutting edge of said second measuring surface;

a second backstop defined between said back stopping edge of said second surface and said top surface;

a means for preventing said platform from slipping, wherein said means couples to said bottom of said first measuring surface;

wherein said first and second measuring surfaces have two pre-drilled screw holes vertically aligned therethrough; and wherein a first securing means couples to said first backstop and a second securing means coupled to said second backstop.

6. The method of using the sandpaper cutting tool of claim 1, the steps comprising:

(a) positioning a sheet of sandpaper atop the first measuring surface by inserting the sandpaper through the opening between the first blade and the first measuring surface by sliding the sandpaper along the first measuring surface and aligning the sandpaper adjacent the first backstop;

(b) securing the sheet of sandpaper by applying pressure to the sandpaper against the first measuring surface;

(c) cutting the sheet of sandpaper into two half sheets by pulling the sheet of sandpaper upwardly at approximately a ninety degree angle along the serrated edge of the first blade;

(d) removing the half sheet of sandpaper remaining atop the first measuring surface by sliding the half sheet of sandpaper through the opening between the first blade and first measuring surface;

(e) positioning the half sheet of sandpaper atop the second measuring surface by rotating the half sheet of sandpaper ninety degrees and inserting the half sheet Of sandpaper through the opening between the second blade and the second measuring surface, sliding the half sheet of sandpaper along the second, measuring surface and aligning the half sheet of sandpaper adjacent the second backstop;

(f) securing the sandpaper by applying pressure to the half sheet of sandpaper against the second measuring surface;

(g) cutting the sandpaper into two one-quarter sheets by pulling the half sheet of sandpaper upwardly at approximately a ninety degree angle along the serrated edge of the second blade; and removing the one-quarter sheet of sandpaper remaining atop the second measuring surface by sliding the one-quarter sheet of sandpaper through the opening between the second blade and second measuring surface.

7. The method of using the sandpaper cutting tool of claim 6, the steps further comprising:

(a) repeating steps (e) through (h) with the remaining half sheet of sandpaper thereby yielding four one-quarter sheets of sandpaper.

* * * * *